US009751737B2

(12) United States Patent
Taylor et al.

(10) Patent No.: US 9,751,737 B2
(45) Date of Patent: Sep. 5, 2017

(54) ARTICULATING ROLLER ASSEMBLY FOR FOUR-POST VEHICLE LIFT

(71) Applicant: VEHICLE SERVICE GROUP, LLC, Madison, IN (US)

(72) Inventors: Steven H. Taylor, Hanover, IN (US); Brian E. Kelley, Madison, IN (US)

(73) Assignee: Vehicle Service Group, LLC, Madison, IN (US)

( * ) Notice: Subject to any disclaimer, the term of this patent is extended or adjusted under 35 U.S.C. 154(b) by 591 days.

(21) Appl. No.: 14/180,510

(22) Filed: Feb. 14, 2014

(65) Prior Publication Data

US 2015/0232311 A1 Aug. 20, 2015

(51) Int. Cl.

| | |
|---|---|
| ***B66F 7/28*** | (2006.01) |
| ***B66F 17/00*** | (2006.01) |
| ***B66F 3/46*** | (2006.01) |
| ***B66F 7/02*** | (2006.01) |

(52) U.S. Cl.

CPC ..... *B66F 7/28* (2013.01); *B66F 3/46* (2013.01); *B66F 7/025* (2013.01); *E05Y 2900/132* (2013.01); *Y10T 16/364* (2015.01)

(58) Field of Classification Search

CPC .... B66F 3/00; B66F 7/28; B66F 17/00; B66F 1/06; B66F 7/26; B66F 9/063; B66F 9/08; B66F 7/025; B66F 3/46; B66F 7/04; B66F 7/22; Y10T 16/364; Y10T 16/3837

USPC ..... 254/45, 89 R, 4 R, 89 H; 16/91, 106; 187/203, 204, 207, 208, 210, 213, 219

See application file for complete search history.

(56) References Cited

U.S. PATENT DOCUMENTS

| | | | | | |
|---|---|---|---|---|---|
| 2,740,607 | A * | 4/1956 | Branick | B66F 7/04 | 254/2 B |
| 2,974,490 | A * | 3/1961 | Hott | B66F 3/42 | 254/2 B |
| 2,992,811 | A * | 7/1961 | Turner | B66F 7/02 | 254/4 B |
| 2,998,960 | A * | 9/1961 | Smith | B66F 7/04 | 254/133 R |
| 3,215,402 | A * | 11/1965 | Hott | B66F 7/025 | 254/7 B |
| 4,141,106 | A * | 2/1979 | Dixon | E05D 15/0613 | 16/104 |

(Continued)

*Primary Examiner* — Larry E Waggle, Jr.
*Assistant Examiner* — Mahdi H Nejad
(74) *Attorney, Agent, or Firm* — Frost Brown Todd LLC; Matthew Schantz

(57) ABSTRACT

An automotive lift system includes a plurality of posts and yoke assemblies. The yoke assemblies are slidably coupled to the posts such that the yoke assemblies are vertically moveable between a lowered position and a raised position. A pair of runways are secured between a respective pair of yoke assemblies and are configured to engage an automobile to thereby communicate vertical movement of the yoke assemblies to the automobile. The yoke assemblies include a structural frame and a pair of contact assemblies configured to engage opposing surfaces of the posts. The contact assemblies include an axle assembly having a pair of contact members (e.g., rollers, sliders, etc.) that are configured to engage an interior or exterior surface of the post. The axle assemblies are rotatable and/or articulable about a vertical axis parallel with the posts to thereby maintain proper engagement between the posts and the pairs of contact members.

20 Claims, 21 Drawing Sheets

(56) References Cited

U.S. PATENT DOCUMENTS 4,599,034 A * 7/1986 Kennedy ..... B66F 7/025 254/89 R
5,009,287 A 4/1991 Starr
5,518,220 A * 5/1996 Bertrand ..... B66F 7/025 254/7 B
5,937,972 A * 8/1999 Andre ..... B60P 1/02 187/210
6,315,079 B1 * 11/2001 Berends ..... B66F 3/46 187/203
6,446,757 B1 9/2002 Taylor
6,679,144 B2 * 1/2004 Yeo ..... B23B 5/04 254/89 R
6,763,916 B2 7/2004 Green et al.
6,817,449 B2 * 11/2004 Berends ..... B66F 7/20 187/213
6,925,848 B2 8/2005 Hess et al.
6,964,322 B2 11/2005 Green et al.
6,983,196 B2 1/2006 Green et al.
7,143,628 B2 12/2006 Hess et al.
7,191,038 B2 3/2007 Green et al.
8,083,034 B2 12/2011 Bordwell et al.
8,286,754 B2 * 10/2012 Cohn ..... B66B 9/0807 187/200
2005/0173202 A1 * 8/2005 Shaw ..... B66F 7/00 187/414
2009/0009360 A1 1/2009 Flannigan et al.
2011/0037041 A1 * 2/2011 DeJong ..... B66F 3/46 254/89 R
2011/0072613 A1 * 3/2011 Hays ..... E05D 13/1276 16/91
2011/0097187 A1 4/2011 Kelley et al.
2012/0018255 A1 * 1/2012 Gross ..... B66F 7/28 187/207
2012/0325587 A1 12/2012 Matthews et al.
2013/0146824 A1 * 6/2013 Drake ..... B66F 7/12 254/92

* cited by examiner

ARTICULATING ROLLER ASSEMBLY FOR FOUR-POST VEHICLE LIFT

BACKGROUND

A variety of automotive lift systems have been made and used over the years in a variety of contexts. An automotive lift is a device operable to lift an automobile such as a car, truck, bus, motorcycle, etc. to a desired height. Some types of automotive lifts are installed in-ground while other types are installed above-ground. Above-ground lifts may include one or more superstructures capable of engaging and lifting an automobile. For instance, such superstructures may include a plurality of vertically adjustable yokes secured to a plurality of posts with one or more runways secured thereto. Such superstructures may be selectively vertically adjustable along a height of the posts relative to the ground to thereby raise and/or lower an automobile relative to the ground. An automobile may be driven onto the runway(s) and thereafter, the superstructures may be raised or lowered to bring the automobile to a desired height. Afterward, the automobile may then be lowered once the user has completed his or her task requiring the automotive lift.

Examples of automotive lifts and related concepts are disclosed in U.S. Pat. No. 5,009,287, entitled "Vehicle Lift," issued Apr. 23, 1991, the disclosure of which is incorporated by reference herein; U.S. Pat. No. 6,446,757, entitled "Lock Mechanism for Lift," issued Sep. 10, 2002, the disclosure of which is incorporated by reference herein; U.S. Pat. No. 6,763,916, entitled "Method and Apparatus for Synchronizing a Vehicle Lift," issued Jul. 20, 2004, the disclosure of which is incorporated by reference herein; U.S. Pat. No. 6,925,848, entitled "Multiple Movable Carriages with Multi-Radius Tracks and Tilted Rollers," issued Aug. 9, 2005, the disclosure of which is incorporated by reference herein; U.S. Pat. No. 6,964,322, entitled "Method and Apparatus for Synchronizing a Vehicle Lift," issued Nov. 15, 2005, the disclosure of which is incorporated by reference herein; U.S. Pat. No. 6,983,196, entitled "Electronically Controlled Vehicle Lift and Vehicle Service System," issued Jan. 3, 2006, the disclosure of which is incorporated by reference herein; U.S. Pat. No. 7,143,628, entitled "Multiple Movable Carriages with Multi-Radius Tracks and Tilted Rollers," issued Dec. 5, 2006, the disclosure of which is incorporated by reference herein; U.S. Pat. No. 7,191,038, entitled "Electronically Controlled Vehicle Lift and Vehicle Service System," issued Mar. 13, 2007, the disclosure of which is incorporated by reference herein; U.S. Pat. No. 8,083,034, entitled "Lift Control Interface," issued Dec. 27, 2011, the disclosure of which is incorporated by reference herein; U.S. Pat. Pub. No. 2009/0009360, entitled "System and Method for Measuring and Recording Distance," published Jan. 8, 2009, the disclosure of which is incorporated by reference herein; U.S. Pat. Pub. No. 2011/0097187, entitled "Vehicle Guidance System for Automotive Lifts," published Apr. 28, 2011, the disclosure of which is incorporated by reference herein; and U.S. Pat. Pub. No. 2012/0325587, entitled "Vehicle Lift with Front Platforms and Rear Carrying Arms," published Dec. 27, 2012, the disclosure of which is incorporated by reference herein.

While a variety of automotive lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
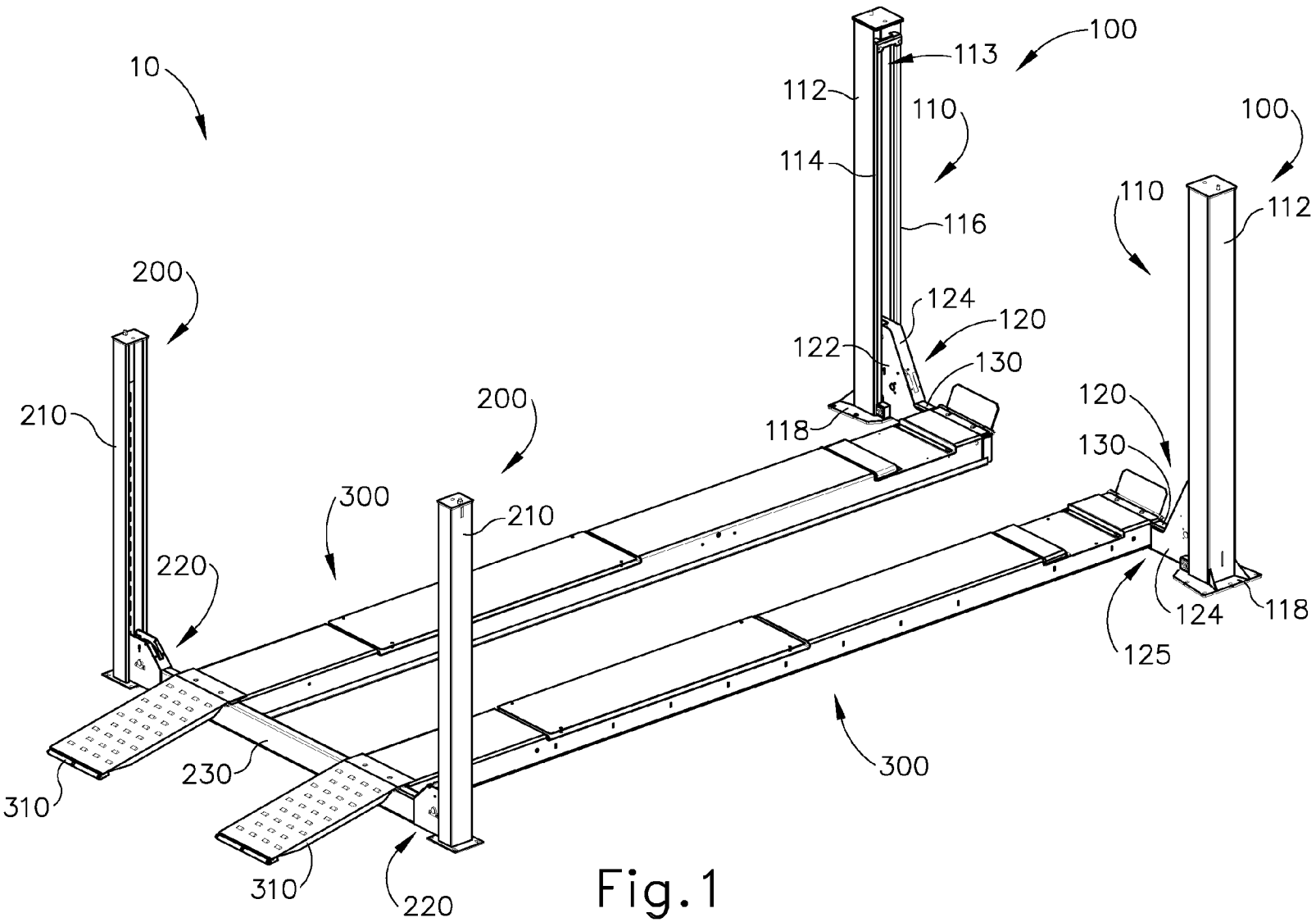
FIG. 1 depicts a perspective view of an exemplary automotive lift.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Automotive Lift System

Figure 2:
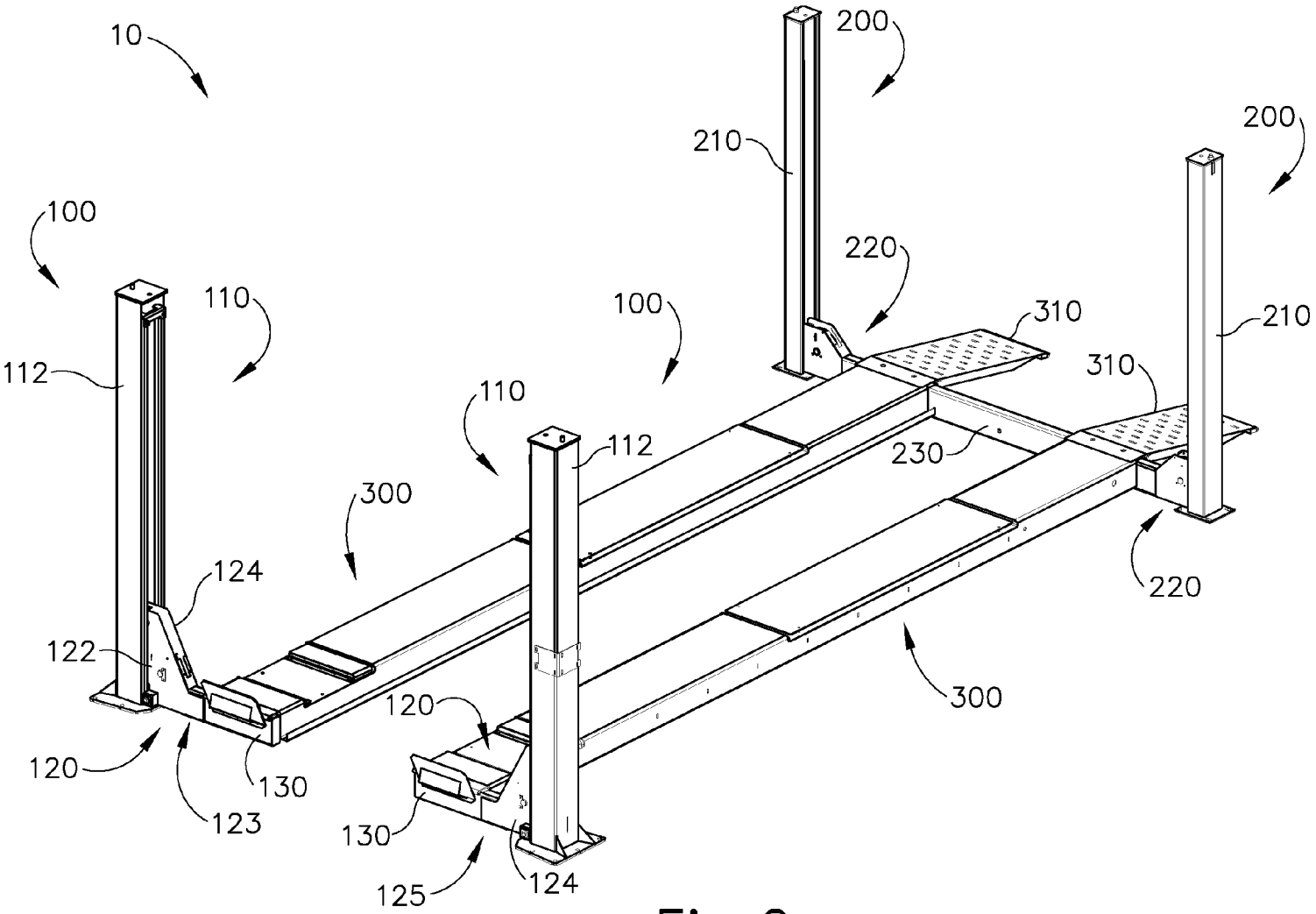
FIG. 2 depicts another perspective view of the automotive lift of FIG. 1.
Figure 3:
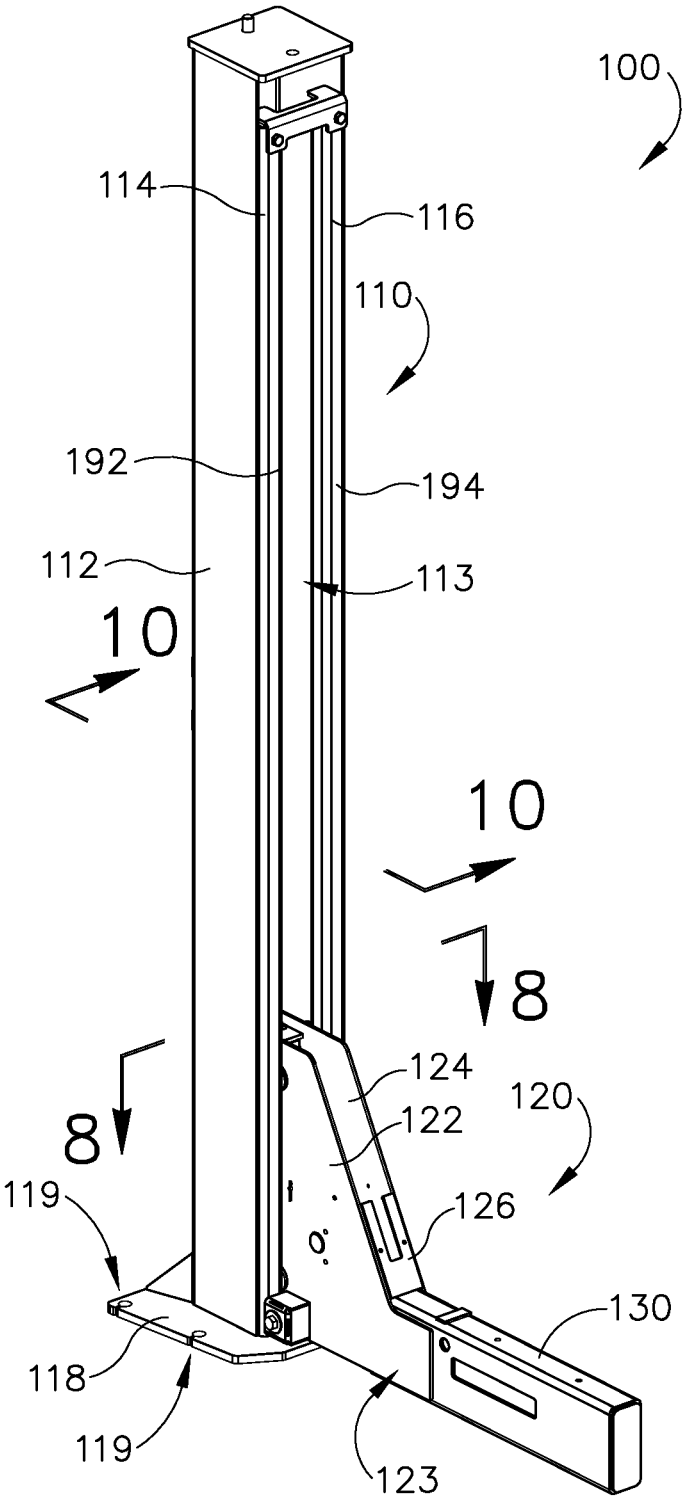
FIG. 3 depicts a perspective view of a post and yoke assembly of the automotive lift of FIG. 1.

FIGS. 1 and 2 show an exemplary automotive lift system (10) comprising a first pair of lift assemblies (100), a second pair of lift assemblies (200), and a pair of runways (300). As shown in FIG. 3, each lift assembly (100) comprises a post (110) and a yoke assembly (120) slidably secured thereto such that yoke assemblies (120) are selectively vertically slidable between a lowered position and a raised position along a height of posts (110). Likewise, each lift assembly (200) comprises a post (210) and a yoke assembly (220) slidably secured thereto such that yoke assemblies (220) are selectively vertically slidable between a lowered position and a raised position along a height of posts (210). Posts (110, 210) of lift assemblies (100, 200) are secured to the ground and arranged in a rectangular orientation such that lift assemblies (100) are arranged laterally relative to one another, such that lift assemblies (200) are arranged laterally relative to one another, and such that lift assemblies (100, 200) are arranged longitudinally relative to one another. Yoke assemblies (120, 220) of lift assemblies (100, 200) extend inwardly from posts (110, 210). A beam (230) extends laterally between yoke assemblies (220) of lift assemblies (200). Pair of runways (300) are secured to yoke assemblies (120, 220) of lift assemblies (100, 200) and extending longitudinally therebetween such that as yoke assemblies (120, 220) move between the lowered position and the raised position, runways (300) concurrently move between the lowered position and the raised position. Each runway (300) comprises a ramp (310) such than an automobile may be driven up onto runways (300) with runways (300) in the lowered position. By way of example only, yoke assemblies (120, 220) and runways (300) may be raised and lowered using hydraulics, cables, screw mechanisms, scissor mechanisms, and/or any other suitable kind of lifting technology.

Figure 4:
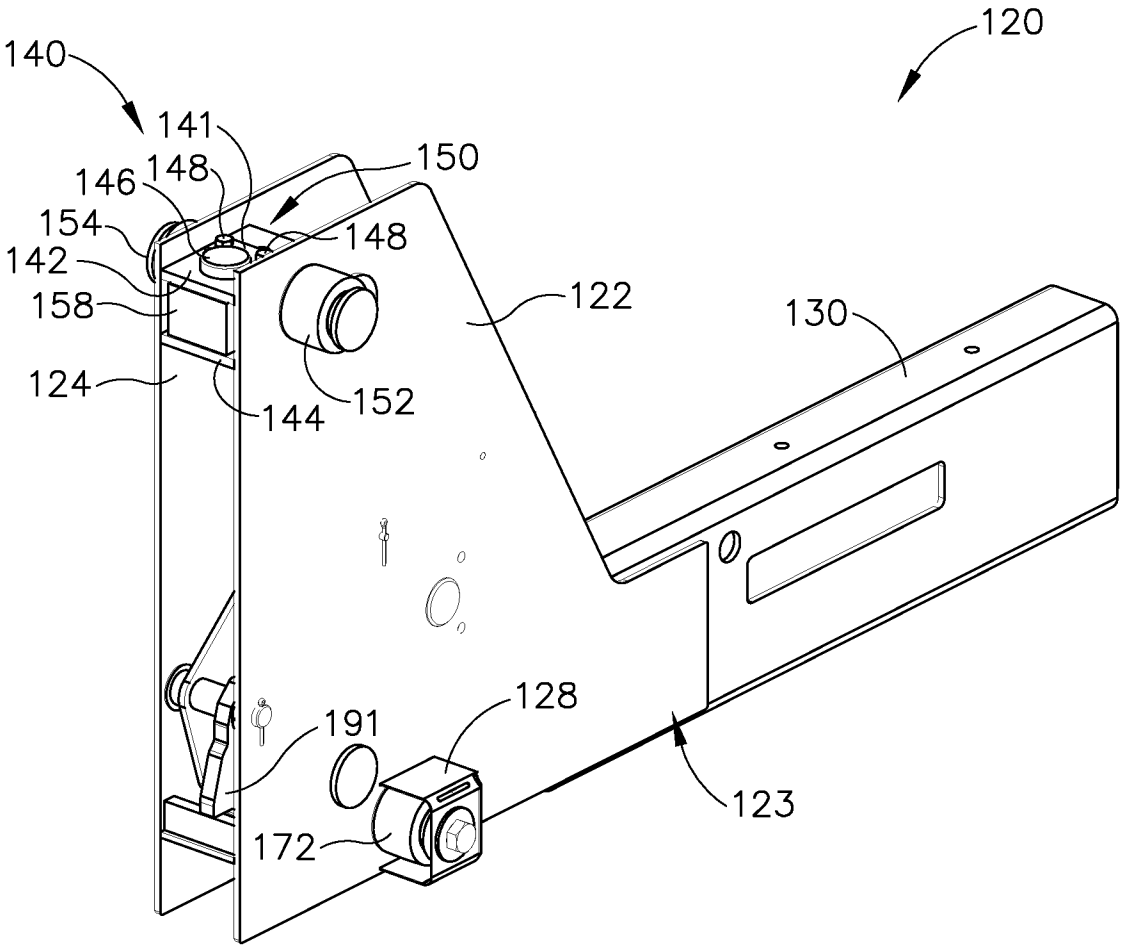
FIG. 4 depicts a perspective view of the yoke assembly of FIG. 3.
Figure 5:
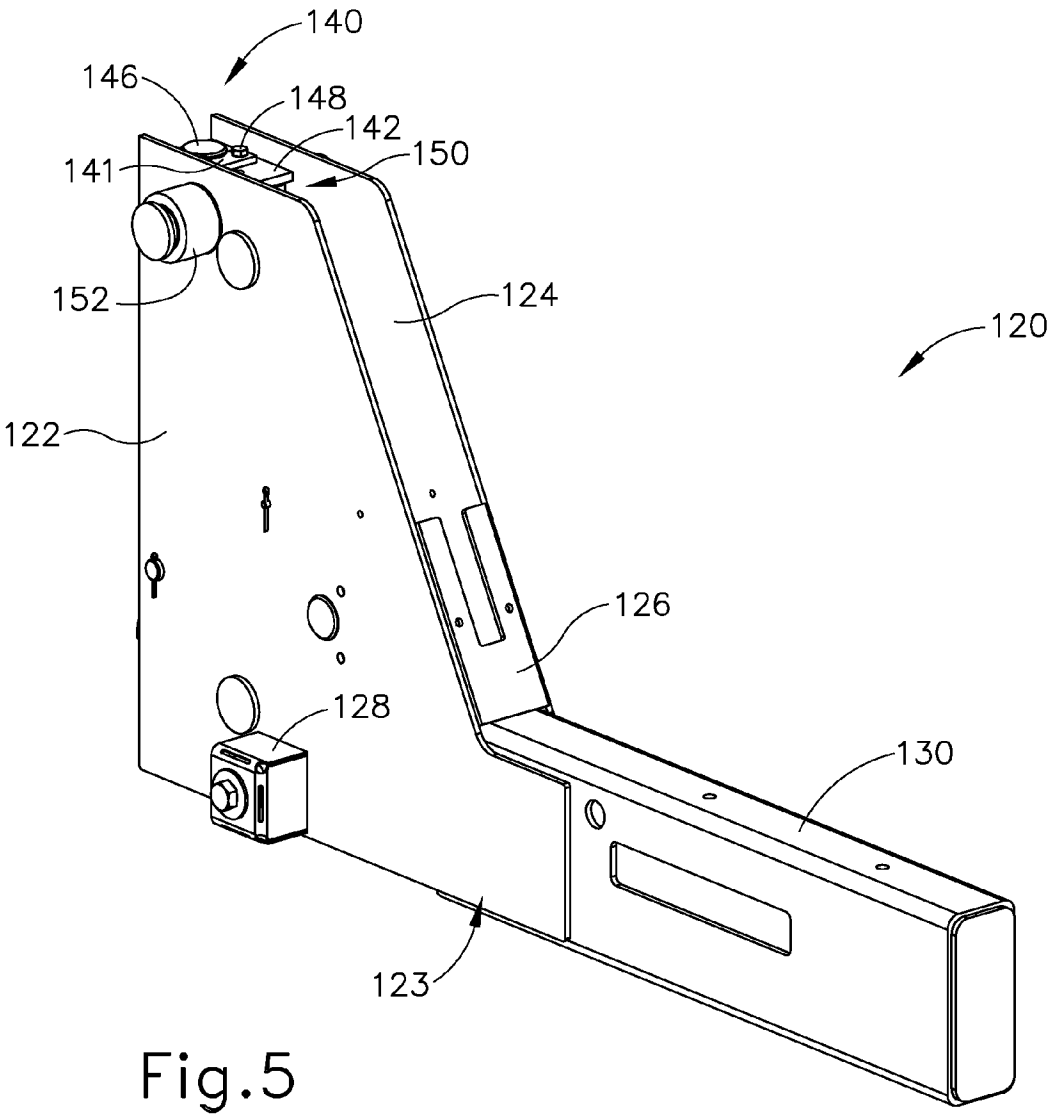
FIG. 5 depicts another perspective view of the yoke assembly of FIG. 3.
Figure 6:
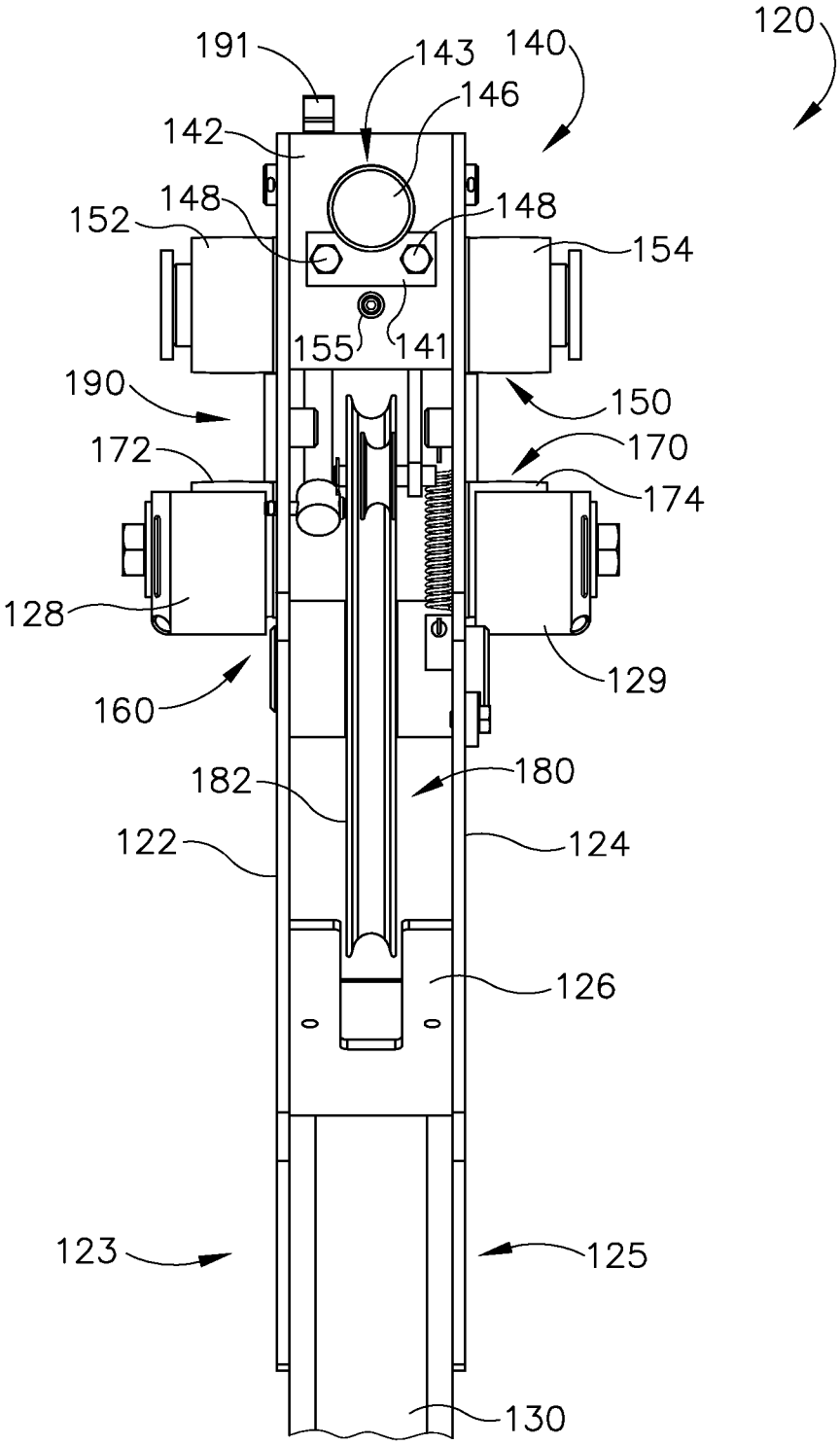
FIG. 6 depicts a top view of the yoke assembly of FIG. 3.
Figure 7:
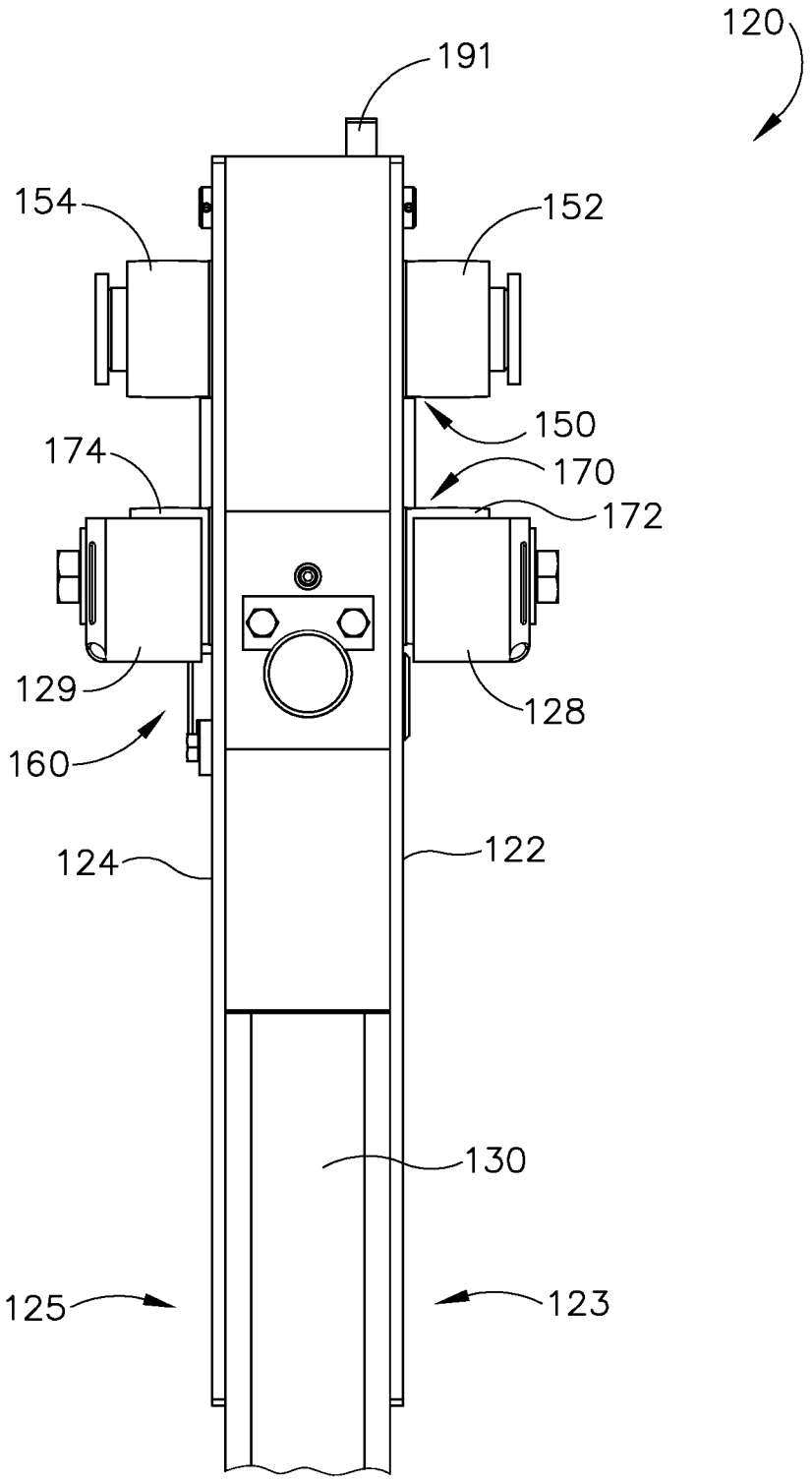
FIG. 7 depicts a bottom view of the yoke assembly of FIG. 3.

FIGS. 4-7 show yoke assembly (120). Yoke assembly (120) comprises a pair of web members (122, 124), a first roller assembly (140), a second roller assembly (160), and a structural tube (130). As best seen in FIG. 5, web members (122, 124) are secured to one another via a stiffening member (126), structural tube (130), and, as will be discussed in more detail below, structural components of roller assemblies (140, 160) to thereby provide structural rigidity to yoke assembly (100). Web members (122, 124) include support portions (123, 125). Structural tube (130) is secured between support portion (123, 125) and extends inwardly therefrom. Runways (300) are secured to yoke assembly (100) via structural tube (130) secured to support portions (123, 125) of web members (122, 124). Thus it should be understood that the weight of an automobile atop runways (300) will be transferred to yoke assembly (120) via structural tube (130) and support portions (123, 125) of web members (122, 124).

Yoke assembly (120) further comprises a driving mechanism (180) and a ratcheting mechanism (190). Driving mechanism (180) of the present example comprises a pulley (182) by which a user may raise or lower yoke assembly (120) using a cable. It should be understood, however, that any appropriate method of driving movement of yoke assembly (120) may be used. Ratcheting mechanism (190) of the present example comprises a pawl (191) rotatable between a locked position and an unlocked position. When pawl (191) is in the locked position, pawl (191) is configured to engage a linear rack (117) of post (110) to thereby lock yoke assembly (120) and runways (300) in a particular vertical position. Pawl (191) may be resiliently biased toward the locked position. Ratcheting mechanism (190) may prevent yoke assembly (120) from dropping suddenly to the ground in the event that one or more drive features of automotive lift system (10) fails (e.g., hydraulic pressure loss, break in drive cable(s), etc.).

Roller assembly (140) is secured between a top portion of web members (122, 124). Roller assembly (140) comprises an axle assembly (150) having a pair of rollers (152, 154). Axle assembly (150) of roller assembly (140) passes through the top portion of web members (122, 124) such that rollers (152, 154) are exposed. Roller assembly (160) is secured between a bottom portion of web members (122, 124). Roller assembly (160) comprises an axle assembly (170) having a pair of rollers (172, 174). Axle assembly (170) of roller assembly (160) passes through the bottom portion of web members (122, 124) such that rollers (172, 174) are exposed. As best seen in FIG. 4, rollers (172, 174) are partially enclosed by a pair of cover plates (128, 129). As will be discussed in more detail below, rollers (152, 154) of roller assembly (140) and rollers (172, 174) of roller assembly (160) are configured transfer the weight of an automobile atop runways (300) to post (110) by bearing against opposing surfaces of post (110) to thereby by prevent rotation of yoke assembly (120) relative to post (110) caused by the weight of the automobile atop runways (300).

Figure 8:
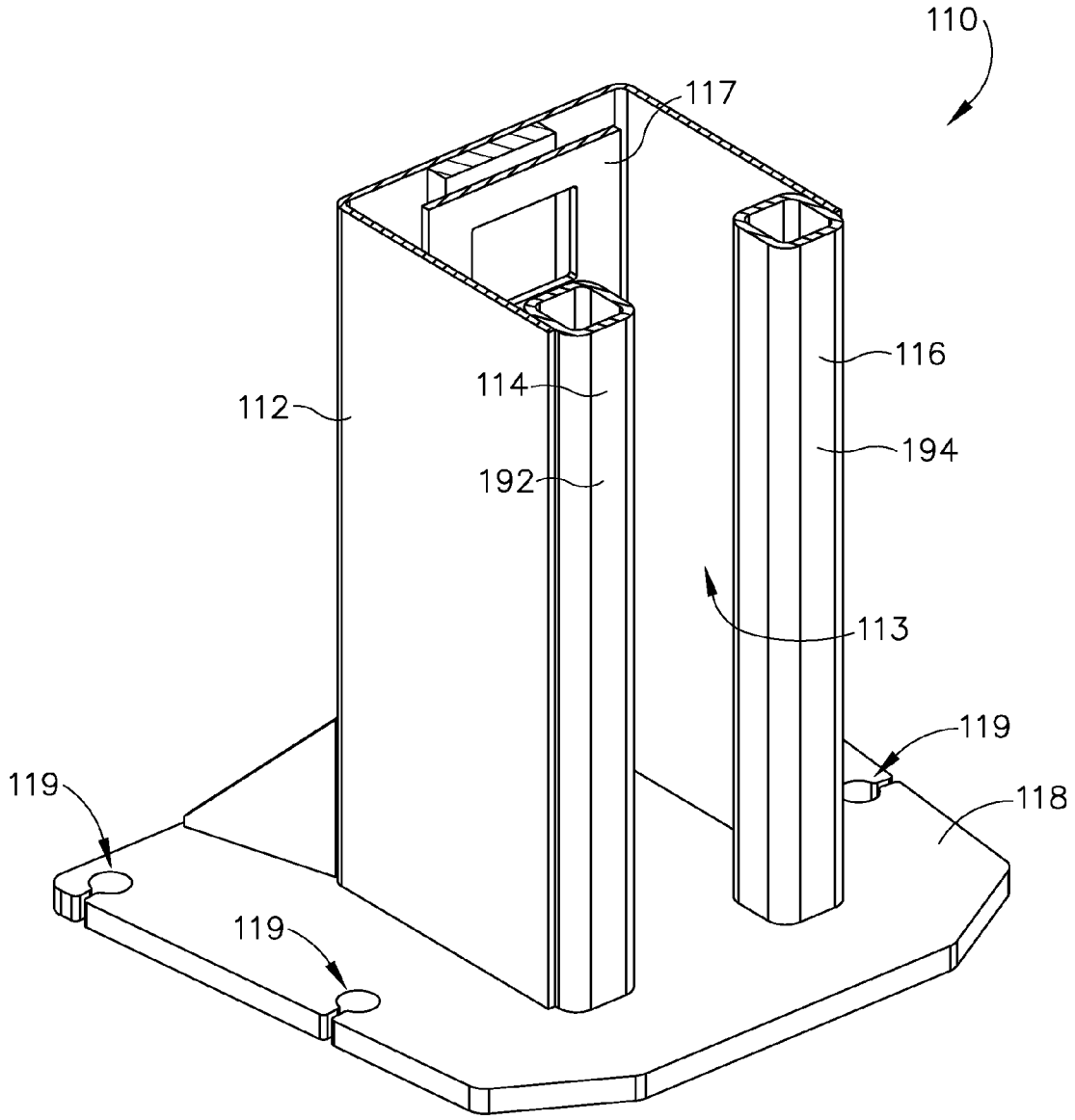
FIG. 8 depicts a perspective cross-sectional view of the post of FIG. 3, taken along line 8-8 of FIG. 3.
Figure 9:
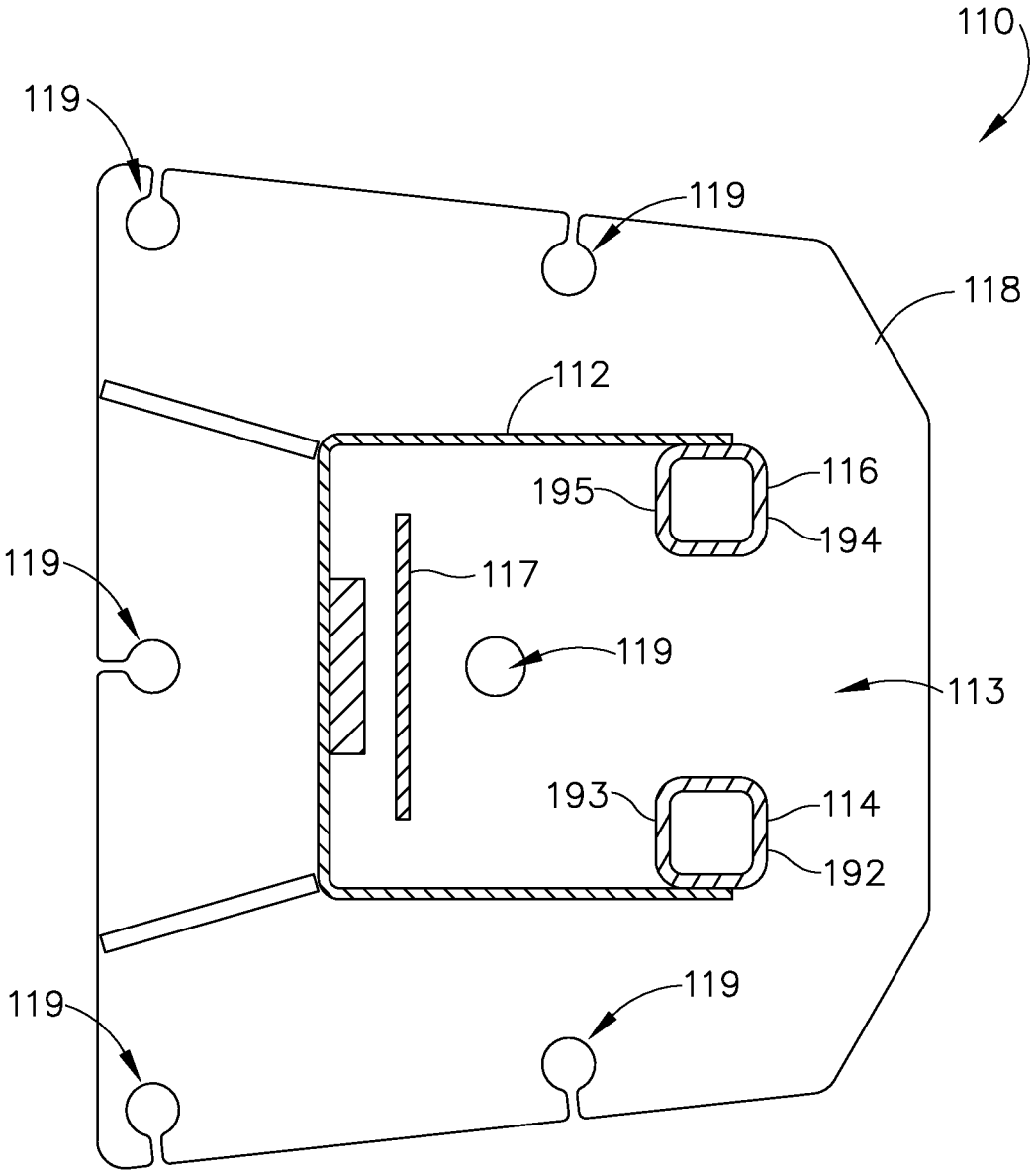
FIG. 9 depicts a top cross-sectional view of the post of FIG. 3, taken along line 8-8 of FIG. 3.

As best seen in FIGS. 8 and 9, post (110) comprises a structural channel member (112) and a pair of square tubular members (114, 116) extending vertically from a base (118). As best seen in FIG. 9, square tubular members (114, 116) are integrally secured to an interior surface of structural channel member (112) adjacent to an opening (113) of structural channel member (112). Base (118) comprises a plurality of through bores (119) by which post (110) may be secured to the ground using bolts, etc. As discussed above, post (110) further comprises linear rack (117) configured to engage pawl (191) of ratcheting mechanism (190) to thereby lock yoke assembly (120) and runways (300) in a particular vertical position. Linear rack (117) is disposed within the interior of post (110).

Figure 10:
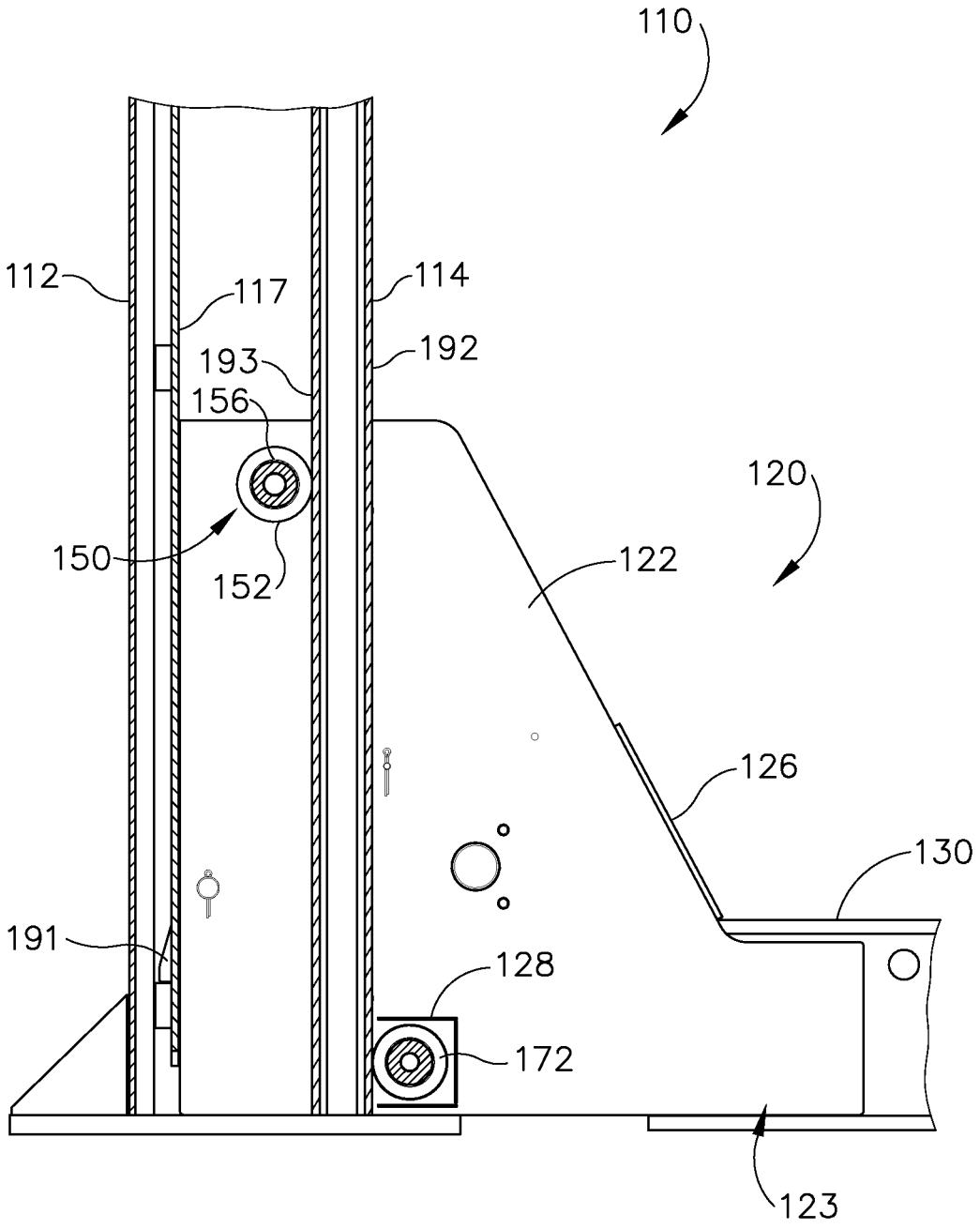
FIG. 10 depicts a side cross-sectional view of the yoke assembly of FIG. 3 engaged with the post of FIG. 3, taken along line 10-10 of FIG. 3.
Figure 11:
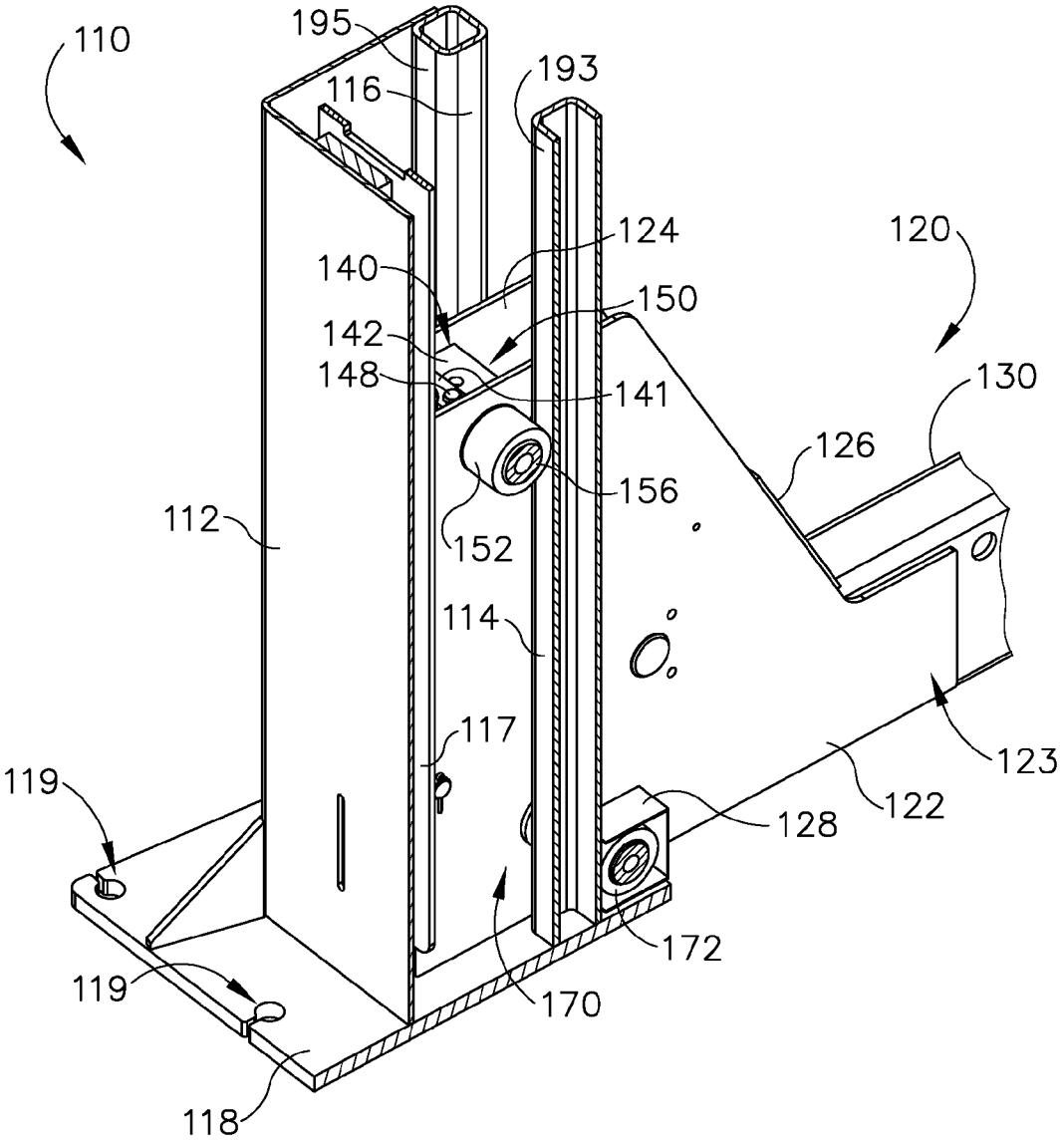
FIG. 11 depicts a perspective cross-sectional view of the yoke assembly of FIG. 3 with the post of FIG. 3, taken along line 10-10 of FIG. 3.
Figure 12:
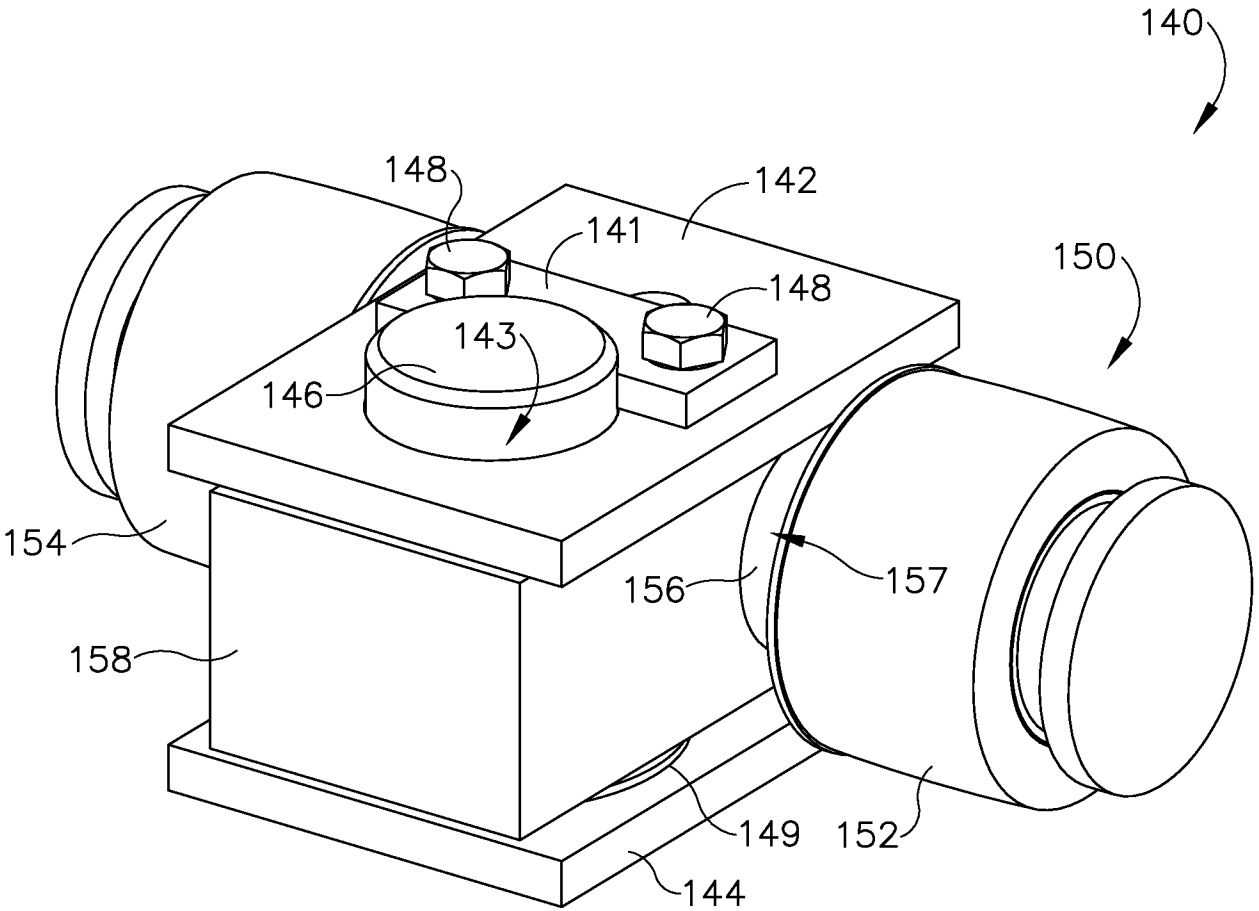
FIG. 12 depicts a perspective view of a first roller assembly of the yoke assembly of FIG. 3.
Figure 13:
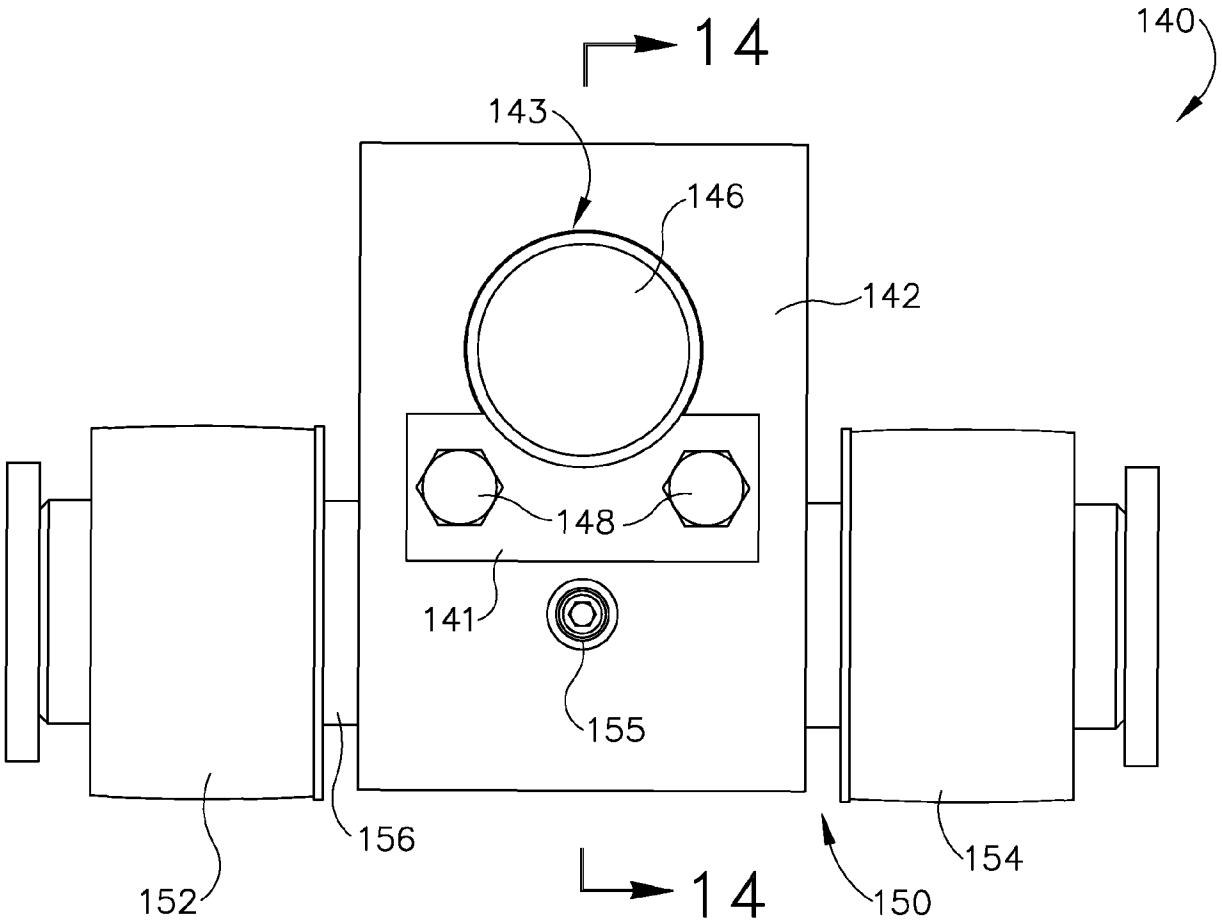
FIG. 13 depicts a top view of the roller assembly of FIG. 12 with an axle assembly in a first rotational position.

As best seen in FIG. 10, axle assembly (150) of roller assembly (140) and axle assembly (170) of roller assembly (160) are arranged to pass through web members (122, 124) such that a horizontal distance, substantially similar to a thickness of square tubular members (114, 116), is defined between roller (152) of axle assembly (150) and roller (172) of axle assembly (170) and between roller (154) of axle assembly (150) and roller (174) of axle assembly (170). When assembled, rollers (152, 154) of axle assembly (150) are configured to bear against interior surfaces (193, 195) of square tubular members (114, 116), whereas rollers (172, 174) of axle assembly (170) are configured to bear against exterior surfaces (192, 194) of square tubular members (114, 116). It should therefore be understood that roller assemblies (140, 160) are operable to transfer the weight of an automobile atop runways (300) to post (110) by bearing against opposing surfaces (192, 193, 194, 195) of square tubular members (114, 116) of post (110) to thereby by prevent rotation of yoke assembly (120) relative to post (110) caused by the weight of the automobile atop runways (300).

It will be appreciated that as an automobile is loaded atop runways (300), or with an automobile atop runways (300), an unequal amount of force may be applied to square tubular members (114, 116) by rollers (152, 154, 172, 174). Furthermore, manufacturing tolerances and/or imperfect installation may cause an unequal amount of force to be applied to square tubular members (114, 116) by rollers (152, 154, 172, 174). In some instances, this unequal force may cause rotation of yoke assembly (120) about post (110) to a point where one or more rollers (152, 154, 172, 174) no longer contact square tubular members (114, 116). Such unequal force may further cause premature failure of roller assemblies (140, 160) and may require overdesigning of roller assemblies (140, 160) to thereby compensate for such failure. It may therefore be desirable to provide axle assemblies (150, 170) capable of rotating/articulating to thereby self-adjust to maintain proper contact between rollers (152, 154, 172, 174) and square tubular members (114, 116) and to thereby provide for a more even distribution of force among rollers (152, 154, 172, 174).

Figure 14:
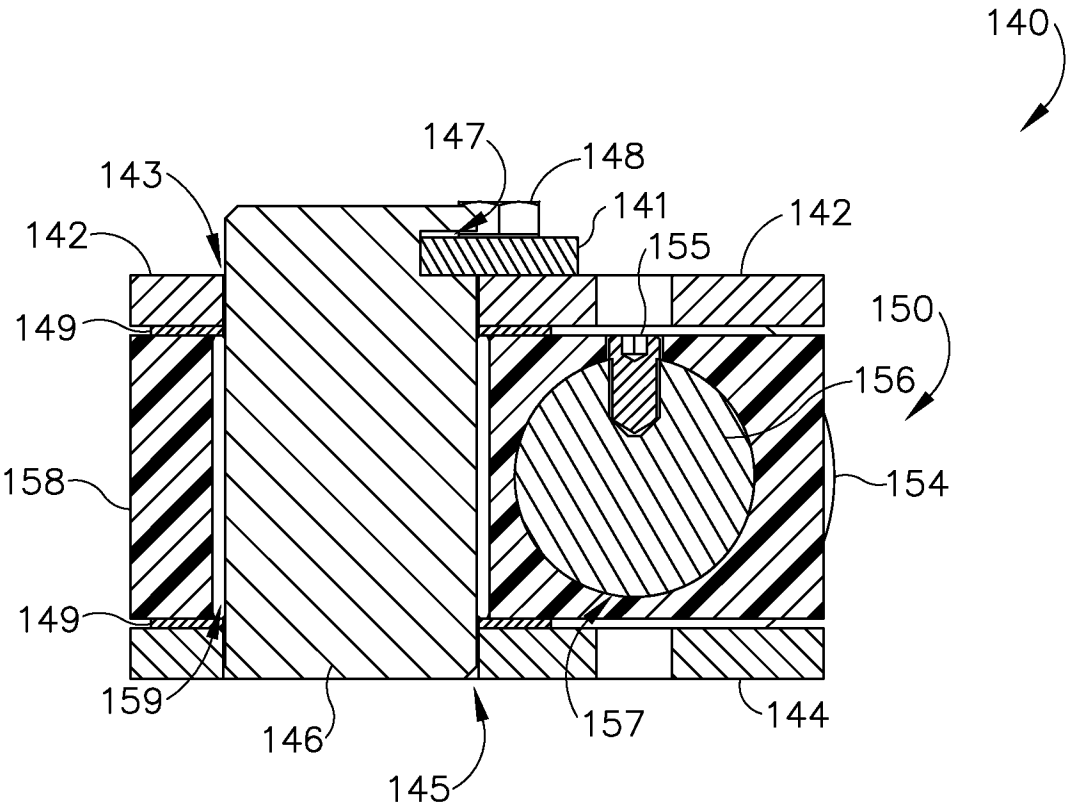
FIG. 14 depicts a side cross-sectional view of the roller assembly of FIG. 12, taken along line 14-14 of FIG. 13.
Figure 15:
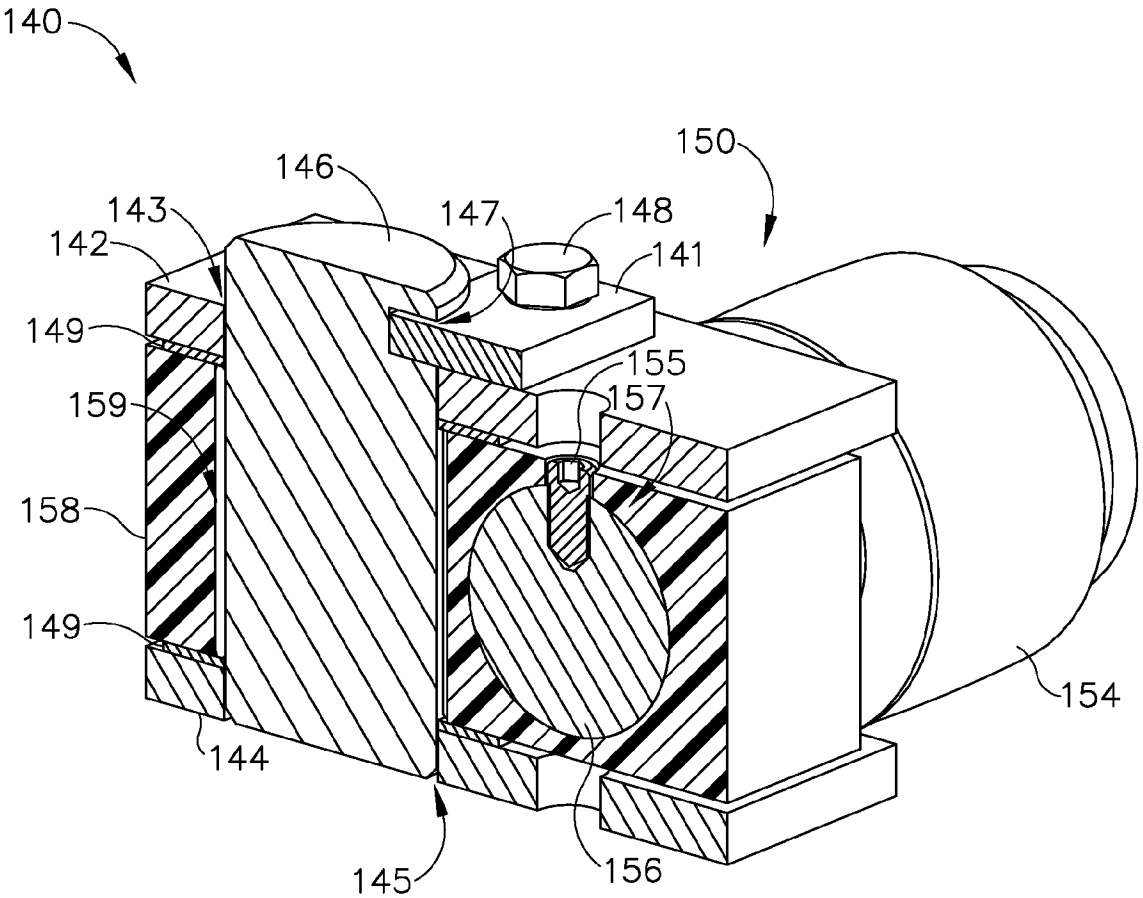
FIG. 15 depicts a perspective cross-sectional view of the roller assembly of FIG. 12, taken along line 14-14 of FIG. 13.

FIGS. 12-16B show roller assembly (140) in greater detail. Roller assembly (140) comprises a first plate (142), a second plate (144), a pin (146), and axle assembly (150). One or both of plates (142, 144) are secured to interior surfaces of web members (122, 124) to thereby provide structural rigidity to yoke assembly (120) and support for roller assembly (140). As best seen in FIGS. 14 and 15, first plate (142) and second plate (144) each comprise a through bore (143, 145). Axle assembly (150) comprises a block (158), an axle (156), and pair of rollers (152, 154). Block (158) comprises a vertical through bore (159). Block (158) is disposed between plates (142, 144) and oriented such that vertical through bore (159) is aligned with through bores (143, 145) of plates (142, 144). Pin (146) is disposed within through bore (143) of plate (142), vertical through bore (159) of block (158), and through bore (145) of plate (144). Pin (146) is held in place by a locking plate (141) secured to first plate (142) via a pair of bolts (148). Locking plate (141) is partially disposed within a transverse notch (147) of pin (146) to thereby prevent pin (146) from sliding axially within through bores (143, 159, 145). As will be discussed in more detail below, block (158) is configured to rotate about pin (146) such that axle assembly (150) is operable to rotate about pin (146).

As best seen in FIG. 14, a pair of washers (149) are positioned between block (158) and plates (142, 144) to thereby prevent wear as block (158) rotates relative to plates (142, 144). Washers (149) further act as stand-offs to minimize surface area contact between block (158) and plates (142, 144), thereby reducing friction between block (158) and plates (142, 144).

Figure 16A:
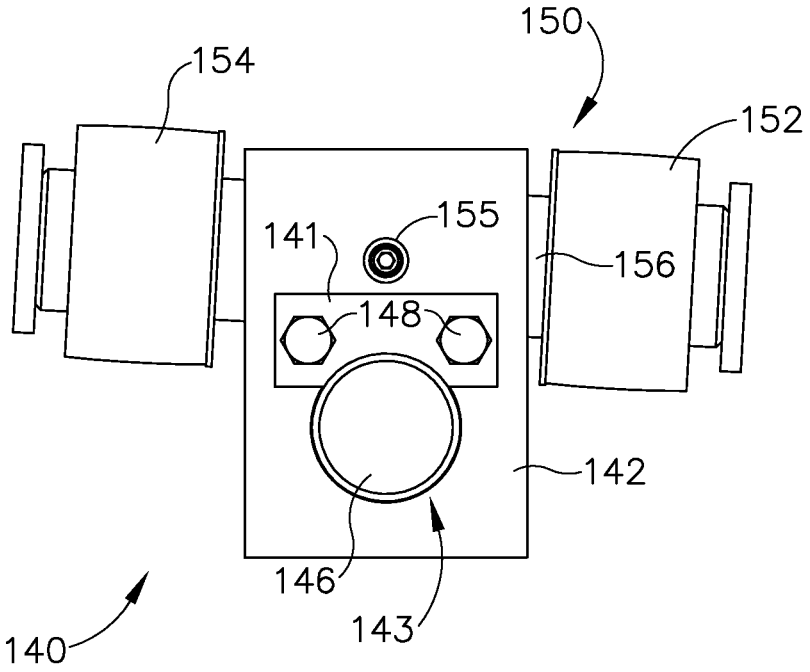
FIG. 16A depicts a top view of the roller assembly of FIG. 12 with the axle assembly of FIG. 13 moved into a first rotational position.
Figure 16B:
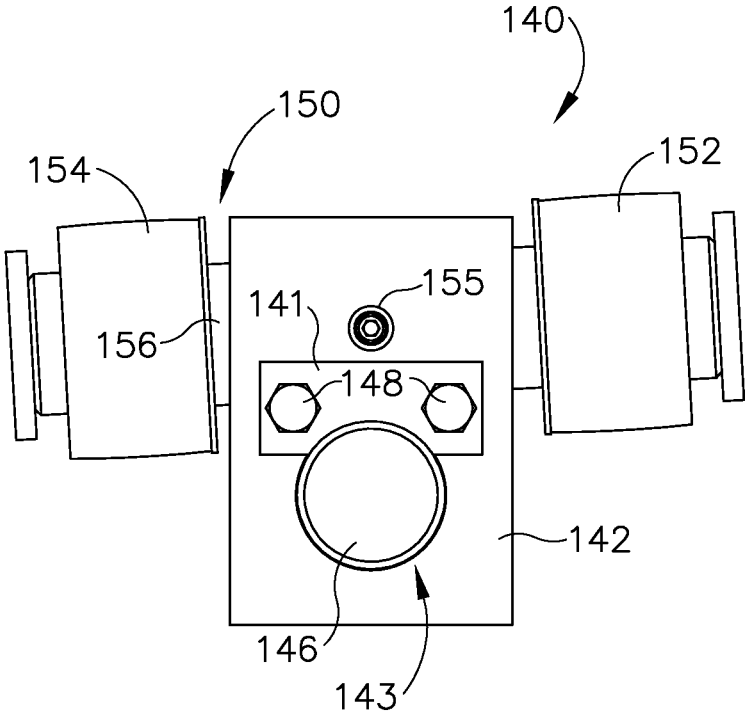
FIG. 16B depicts a top view of the roller assembly of FIG. 12 with the axle assembly of FIG. 13 moved into a second rotational position.
Figure 17:
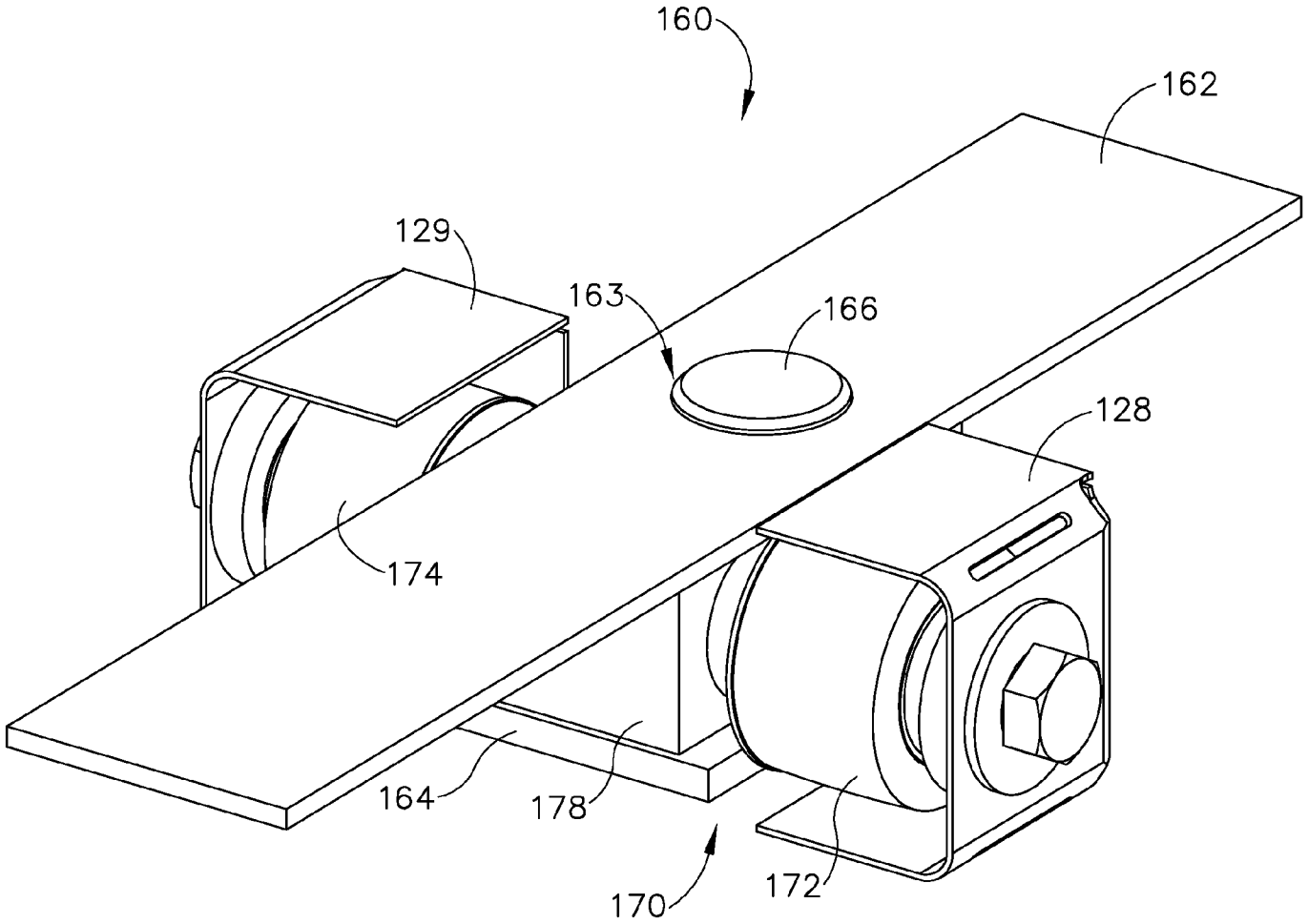
FIG. 17 depicts a perspective view of a second roller assembly of the yoke assembly of FIG. 3.
Figure 18:
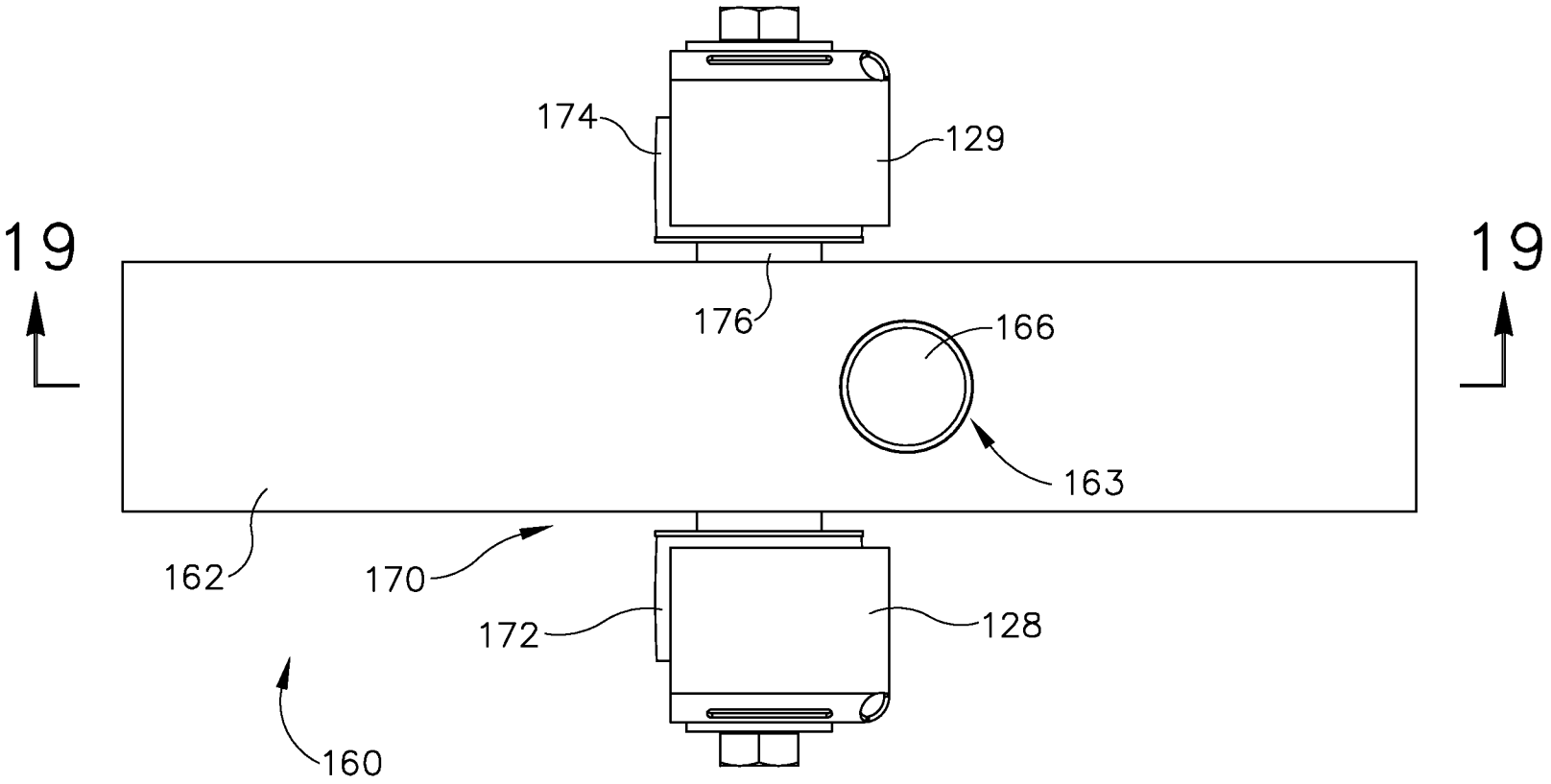
FIG. 18 depicts a top view of the roller assembly of FIG. 17 with an axle assembly in a first rotational position.

Rollers (152, 154) are rotatably coupled to opposite ends of axle (156) such that rollers (152, 154) are operable to rotate about axle (156). As mentioned above, block (158) is rotatably disposed about pin (146) such that block (158) is operable to rotate about pin (146). Block (158) comprises a horizontal through bore (157). Axle (156) of axle assembly (150) is disposed within horizontal through bore (157) of block (158) and secured therein by a set screw (155) such that block (158), axle (156), and rollers (152, 154) rotate concurrently about pin (146). (As best seen in FIG. 15, plates (142, 144) each comprise a through bore configured to provide access to set screw (155)). Thus, it should be understood that axle assembly (150) is operable to rotate about pin (146) to thereby self-adjust and maintain proper contact between rollers (152, 154) and interior surfaces (193, 195) of square tubular members (114, 116) and to thereby provide for a more even distribution of force among rollers (152, 154). In particular, as shown in FIGS. 16A and 16B, axle assembly (150) is rotatable between a first rotational position (FIG. 16A) and a second rotational position (FIG. 16B). It should therefore be understood that pin (146) provides for rotation of block (158) and axle assembly (150) about a vertical axis (i.e., an axis that extends parallel to the post (110)). Furthermore, block (158) and/or axle (156) may comprise a flexible material, such as a rubber coating on steel, to thereby provide for further rotation/articulation of axle (156) and rollers (152, 154).

It should be understood that axle (156) may be rotatably disposed within through bore (157) of block (158) in addition to or in lieu of rollers (152, 154) being rotatably coupled with axle (150).

As discussed above, axle assembly (150) extends through web members (122, 124) such that rollers (152, 154) are exposed. In particular, axle (156) of axle assembly (150) extends through a pair of through bores (not shown) formed in the top portions of web members (122, 124). Such through bores may be circular shaped and sized to provide for movement of axle (156) during rotation of axle assembly (150). For instance, the inner diameters of such bores may be greater than the outer diameter of axle (156), thereby providing clearance for movement of axle (156) within the through bores of web members (122, 124) as axle assembly (150) pivots about the longitudinal axis of pin (146). Alternatively, such through bores may be oblong shaped to provide for movement of axle (156) during pivotal movement of axle assembly (150) about the longitudinal axis of pin (146).

Figure 19:
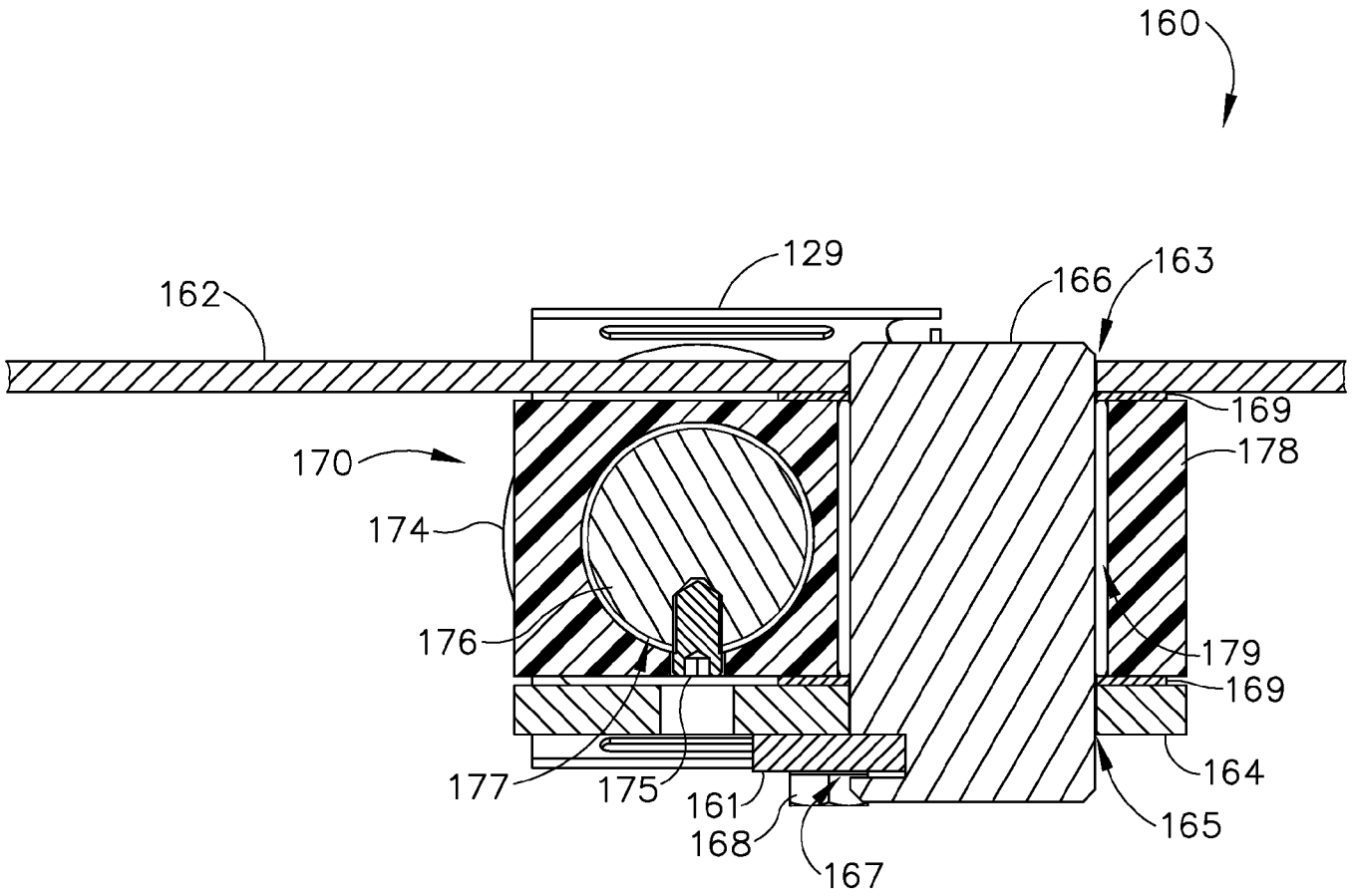
FIG. 19 depicts a side cross-sectional view of the roller assembly of FIG. 17, taken along line 19-19 of FIG. 18.
Figure 20:
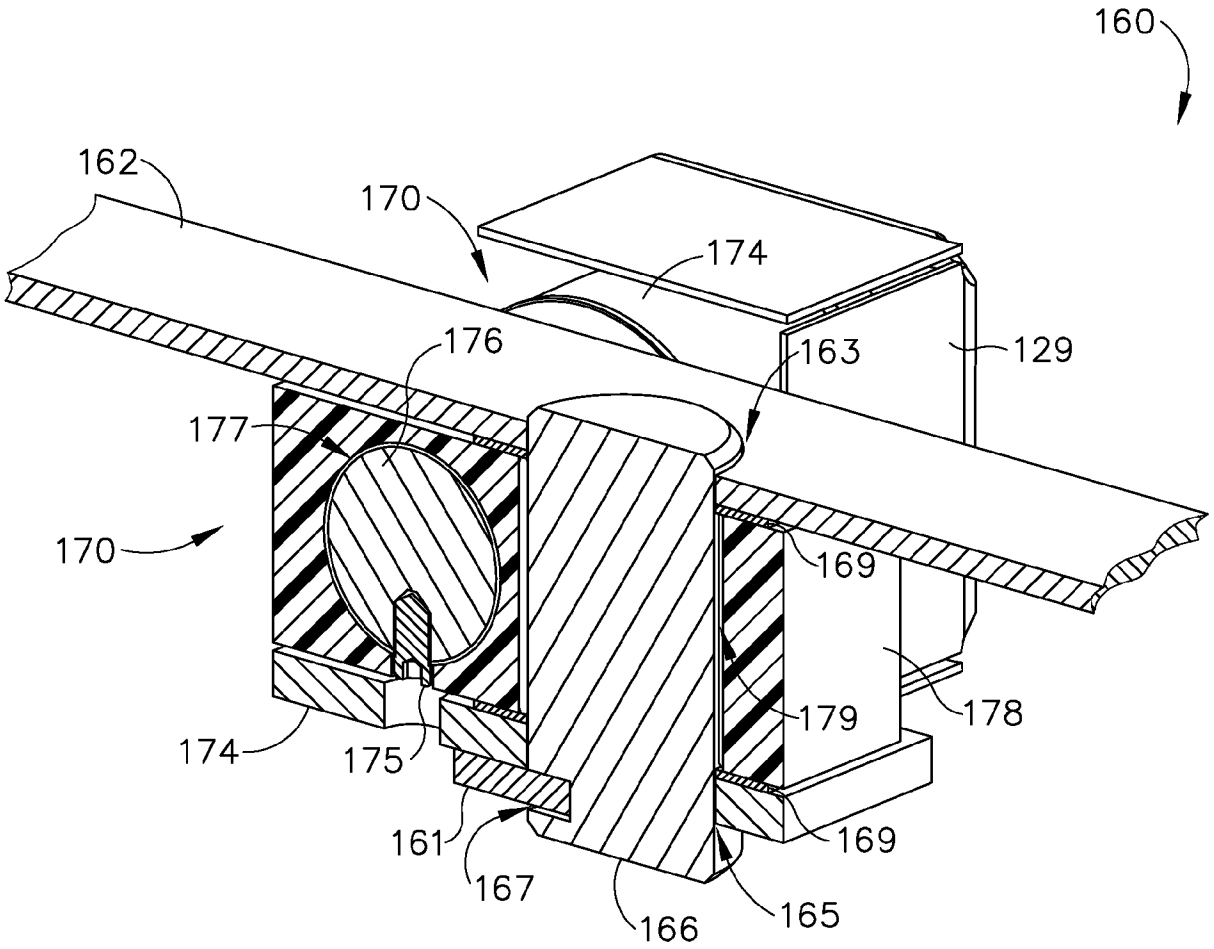
FIG. 20 depicts a perspective cross-sectional view of the roller assembly of FIG. 17, taken along line 19-19 of FIG. 18.

FIGS. 17-21B show roller assembly (160) in greater detail. Roller assembly (160) comprises a first plate (162), a second plate (164), a pin (166), and axle assembly (170). One or both of plates (162, 164) are secured to interior surfaces of web members (122, 124) to thereby provide structural rigidity to yoke assembly (120) and support for roller assembly (160). As best seen in FIGS. 19 and 20, first plate (162) and second plate (164) each comprise a through bore (163, 165). Axle assembly (170) comprises a block (178), an axle (176) and pair of rollers (172, 174). Block (178) comprises a vertical through bore (179). Block (178) is disposed between plates (162, 164) and oriented such that vertical through bore (179) is aligned with through bores (163, 165) of plates (162, 164). Pin (166) is disposed within through bore (163) of plate (162), vertical through bore (179) of block (178), and through bore (165) of plate (164). Pin (146) is held in place by a locking plate (161) secured to second plate (164) via a pair of bolts (168). Locking plate (161) is partially disposed within a transverse notch (167) of pin (166) to thereby prevent pin (166) from sliding axially within through bores (163, 179, 165). As will be discussed in more detail below, block (178) is configured to rotate about pin (166) such that axle assembly (170) is operable to rotate about pin (166).

As best seen in FIG. 19, a pair of washers (169) are positioned between block (168) and plates (162, 164) to thereby prevent wear as block (168) rotates relative to plates (162, 164). Washers (169) further act as stand-offs to minimize surface area contact between block (168) and plates (162, 164), thereby reducing friction between block (168) and plates (162, 164).

Figure 21A:
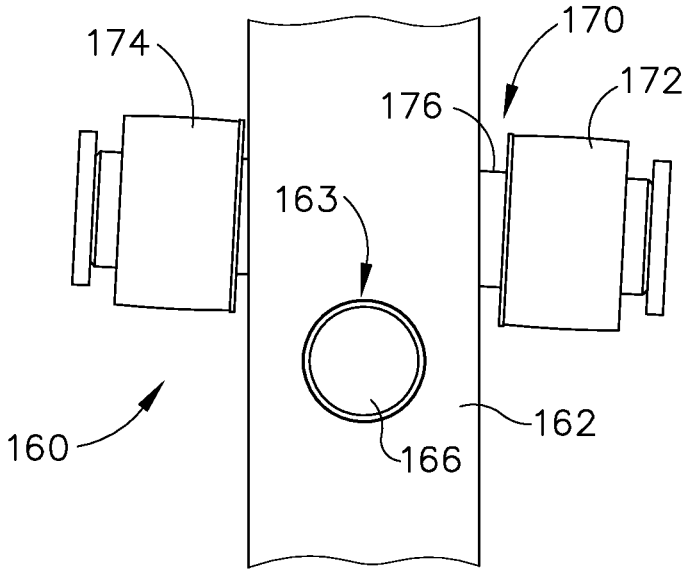
FIG. 21A depicts a top view of the roller assembly of FIG. 17 with the axle assembly of FIG. 18 moved into a first rotational position.
Figure 21B:
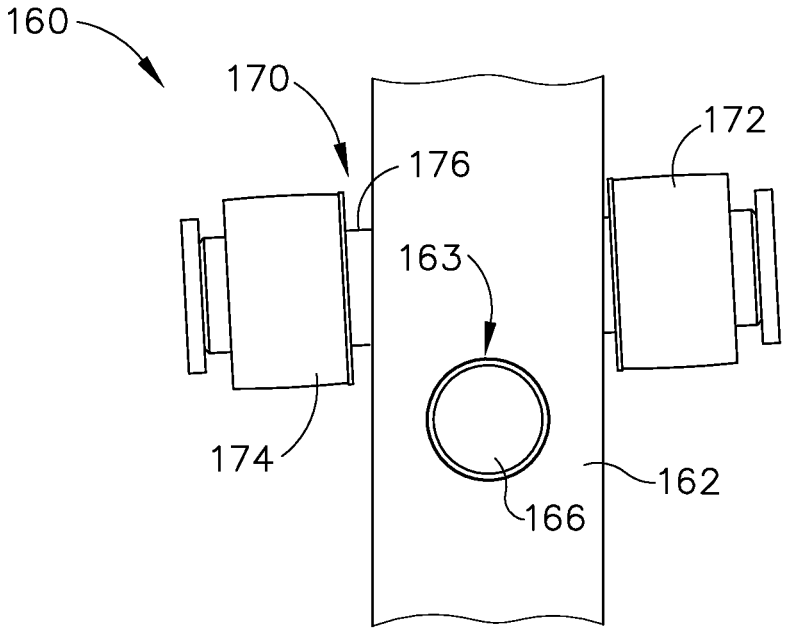
FIG. 21B depicts a top view of the roller assembly of FIG. 17 with the axle assembly of FIG. 18 moved into a second rotational position.

Rollers (172, 174) are rotatably coupled to opposite ends of axle (176) such that rollers (172, 174) are operable to rotate about axle (176). As mentioned above, block (178) is rotatably disposed about pin (166) such that block (178) is operable to rotate about pin (166). Block (178) comprises a horizontal through bore (177). Axle (176) of axle assembly (170) is disposed within horizontal through bore (177) of block (178) and secured therein by a set screw (175) such that block (178), axle (176), and rollers (172, 174) rotate concurrently about pin (166). (As best seen in FIG. 19, plates (162, 164) each comprise a through bore configured to provide access to set screw (175)). Thus, it should be understood that axle assembly (170) is operable to rotate about pin (166) to thereby self-adjust to maintain proper contact between rollers (172, 174) and exterior surfaces (192, 194) of square tubular members (114, 116) and to thereby provide for a more even distribution of force among rollers (172, 174). In particular, as shown in FIGS. 21A and 21B, axle assembly (170) is rotatable between a first rotational position (FIG. 21A) and a second rotational position (FIG. 21B). It should therefore be understood that pin (166) provides for rotation of block (178) and axle assembly (170) about a vertical axis (i.e., an axis that extends parallel to the post (110)). Furthermore, block (178) and/or axle (176) may comprise a flexible material, such as a rubber coating on steel, to thereby provide for further rotation/articulation of axle (176) and rollers (172, 174).

It should be understood that axle (176) may be rotatably disposed within through bore (177) of block (178) in addition to or in lieu of rollers (172, 174) being rotatably coupled with axle (170).

As discussed above, axle assembly (170) extends through web members (122, 124) such that rollers (172, 174) are exposed. In particular, axle (176) of axle assembly (170) extends through a pair of through bores (not shown) formed in the bottom portions of web members (122, 124). Such through bores may be circular shaped and sized to provide for movement of axle (176) during rotation of axle assembly (170). For instance, the inner diameters of such bores may be greater than the outer diameter of axle (176), thereby providing clearance for movement of axle (176) within the through bores of web members (122, 124) as axle assembly (170) pivots about the longitudinal axis of pin (166). Alternatively, such through bores may be oblong shaped to provide for movement of axle (176) during pivotal movement of axle assembly (170) about the longitudinal axis of pin (166).

From the discussion above it should be appreciated that axle assemblies (150, 170) are operable to rotate/articulate to thereby maintain proper contact between rollers (152, 154, 172, 174) and square tubular members (114, 116) and to thereby provide for a more even distribution of force among rollers (152, 154, 172, 174). Such operability may minimize premature failure of roller assemblies (140, 160) and may reduce the need to overdesign roller assemblies (140, 160) to thereby compensate for such failure.

It should be appreciated that although yoke assembly (120) of the present example is described as engaging post (110) via rollers (152, 154, 172, 174) of roller assemblies (140, 160), yoke assembly (120) may engage post (110) by any other appropriate means. For instance, yoke assembly (120) may engage post (110) via sliders in addition to or in lieu of rollers (152, 154, 172, 174). Such sliders may include sliding blocks, sliding cylinders, and/or various other structures. By way of example only, sliders may be formed of a low friction, high density plastic material shaped like a cylinder that is fixedly secured to each end of axle (156, 176) in place of rollers (152, 154, 172, 174). Other suitable materials (and combinations of materials) that may be used to form sliders will be apparent to those of ordinary skill in the art in view of the teachings herein. Similarly, other suitable configurations that sliders may take will be apparent to those of ordinary skill in the art in view of the teachings herein.

II. Miscellaneous

It should be understood that any of the versions of instruments described herein may include various other features in addition to or in lieu of those described above. By way of example only, any of the instruments described herein may also include one or more of the various features disclosed in any of the various references that are incorporated by reference herein. It should also be understood that the teachings herein may be readily applied to any of the instruments described in any of the other references cited herein, such that the teachings herein may be readily combined with the teachings of any of the references cited herein in numerous ways. Other types of instruments into which the teachings herein may be incorporated will be apparent to those of ordinary skill in the art.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An apparatus for raising/lowering an automobile, the apparatus comprising:

(a) at least one post, wherein the at least one post is arranged substantially vertically;

(b) at least one yoke assembly, wherein the at least one yoke assembly is engaged with one or more of the at least one post, wherein the at least one yoke assembly is vertically moveable along the at least one post between a first vertical position and a second vertical position, wherein the at least one yoke assembly comprises:

(i) a structural frame, wherein the structural frame comprises a hollow interior, (ii) at least one contact assembly secured to the structural frame, wherein the at least one contact assembly comprises an axle and a pair of contact members configured to engage the at least one post, wherein the axle is rotatable about a vertical axis to thereby maintain engagement between the at least one post and the pair of contact members, wherein each contact member in the pair of contact members is rotatable about a second axis defined by the axle, and wherein the vertical axis is perpendicular to the second axis; and (c) an automobile engagement feature, wherein the automobile engagement feature is secured to the structural frame of the at least one yoke assembly, wherein the automobile engagement feature is configured to engage the automobile to thereby communicate vertical movement of the at least one yoke assembly to the automobile.

2. The apparatus of claim 1, wherein the at least one post comprises four posts.

3. The apparatus of claim 1, wherein the at least one yoke assembly comprises two yoke assemblies.

4. The apparatus of claim 1, wherein the at least one contact assembly engages opposing surfaces of the at least one post.

5. The apparatus of claim 1, wherein the at least one contact assembly of the at least one yoke assembly comprises a first contact assembly and a second contact assembly.

6. The apparatus of claim 5, wherein a pair of contact members of the first contact assembly engages an interior surface of the at least one post, wherein a pair of contact members of the second contact assembly engages an exterior surface of the at least one post.

7. The apparatus of claim 5, wherein the first contact assembly and the second contact assembly are secured to opposite portions of the structural frame of the at least one yoke assembly.

8. The apparatus of claim 1, wherein the at least one contact assembly further comprises a pair of stiffening members, wherein the axle is rotatably disposed between the pair of stiffening members.

9. The apparatus of claim 1, wherein the axle further comprises a core member and an axle, wherein the pair of contact members comprise rollers, wherein the rollers are rotatably coupled to the axle.

10. The apparatus of claim 9, wherein the axle is disposed within the core member.

11. The apparatus of claim 9, wherein one or both of the axle or the core member comprise a flexible material.

12. The apparatus of claim 1, wherein the automobile engagement feature comprises at least one runway.

13. The apparatus of claim 1, wherein the at least one yoke assembly further comprises a locking mechanism configured to lock the at least one yoke assembly in a particular vertical position along the at least one post.

14. The apparatus of claim 1, wherein the at least one yoke assembly further comprises a driving mechanism configured to drive movement of the at least one yoke assembly between the first vertical position and the second vertical position.

15. The apparatus of claim 1, wherein the at least one post comprises a pair of square tubular members.

16. The apparatus of claim 1, wherein the at least one contact assembly is partially disposed within the hollow interior of the structural frame.

17. A yoke assembly for raising/lowering an automobile, wherein the yoke assembly is moveable between a first vertical position and a second vertical position along a length of a support member, and wherein the yoke assembly comprises:

(a) a structural frame comprising a pair of web members; and (b) at least one roller assembly, wherein the at least one roller assembly comprises:

(i) a pair of stiffening members, wherein the pair of stiffening members are disposed between the pair of web members, wherein at least one stiffening member of the pair of stiffening members is secured to an interior surface of the pair of web members, (ii) an axle assembly rotatably coupled with the pair of stiffening members, wherein the axle assembly comprises an axle, a core member, and a pair of rollers, wherein each roller of the pair of rollers is rotatable about a first axis defined by the axle, and wherein the axle assembly is rotatable or articulable about a second axis perpendicular to the first axis to thereby maintain engagement between the pair of rollers and the support member.

18. The assembly of claim 17, wherein the second axis is aligned vertically.

19. The assembly of claim 17, wherein each stiffening member in the pair of stiffening members comprises one or more plates.

20. An apparatus for raising/lowering an automobile, the apparatus comprising:

(a) a pair of posts, wherein each post of the pair of posts is arranged substantially vertically;

(b) a first yoke assembly, wherein the first yoke assembly is engaged with a first post of the pair of posts, wherein the first yoke assembly is vertically moveable along the first post between a first vertical height and a second vertical height, wherein the first yoke assembly comprises at least one roller assembly, wherein the at least one roller assembly comprises a pin and an axle assembly, wherein the pin defines a longitudinal axis oriented parallel to the first post, wherein the axle assembly is configured to engage the first post, wherein the axle assembly is rotatable about the longitudinal axis of the pin to thereby maintain engagement between the at least one post and the axle assembly;

(c) a second yoke assembly, wherein the second yoke assembly is engaged with a second post of the pair of posts, wherein the second yoke assembly is vertically moveable along the second post between the first vertical height and the second vertical height; and (c) an automobile engagement feature, wherein a first end of the automobile engagement feature is secured to the first yoke assembly, wherein a second end of the automobile engagement feature is secured to the second yoke assembly, wherein the automobile engagement feature is configured to engage the automobile to thereby communicate vertical movement of the first yoke assembly and the second yoke assembly to the automobile.

* * * * *